US005145516A

United States Patent [19]

Khodr

[11] Patent Number: 5,145,516

[45] Date of Patent: Sep. 8, 1992

[54] COMPOSITION FOR COATING ELECTRODES OF A SURGE ARRESTER

[75] Inventor: Riad Khodr, Lille, France

[73] Assignee: Pendar Industries, Proville, France

[21] Appl. No.: 171,633

[22] Filed: Mar. 22, 1988

[51] Int. Cl.[5] ..... C23C 24/00

[52] U.S. Cl. ..... 106/1.12; 420/551

[58] Field of Search ..... 106/1.05, 194, 1.12; 252/512; 338/21; 420/415, 418, 550, 551, 552

[56] References Cited

U.S. PATENT DOCUMENTS 2,223,977 12/1940 Wamsley ..... 252/512
2,813,791 11/1957 Gullett ..... 420/418
4,692,735 9/1987 Shoji et al. ..... 338/21

*Primary Examiner*—William R. Dixon, Jr.
*Assistant Examiner*—Chris Gallo
*Attorney, Agent, or Firm*—Thomas A. O'Rourke

[57] ABSTRACT

The present invention is directed to coating compositions of surge arrester electrodes which do not contain any radioactive materials and which permit the surge arrester to operate both in a well-lighted environment and in a dark environment.

The coating composition for the electrodes of a surge arrester contains at least some aluminium, titanium and a product of the type MA or $M^{n+}$, $A^{n-}$ in which M represents an alkaline metal, A a sulphate or a carbonate of this metal and n is equal to 1 or 2.

The invention has preferred application for the coating of the electrodes of miniature or three element surge arresters.

9 Claims, 2 Drawing Sheets

COMPOSITION FOR COATING ELECTRODES OF A SURGE ARRESTER

The present invention is directed to surge arresters and more particularly an improved coating of their electrodes without the use of any radioactive components.

A surge arrester is a well-known device designed to protect electrical installations against damage by electrical surges caused, for example, by lightning discharges, static electricity, resumption of full power after blackouts, brownouts, etc. Electrical surges may also be caused by a failure of public utilities to provide a steady current stream to their customers. Computers and other electrical equipment are particularly sensitive to electrical surges and delicate electrical components and even data may be destroyed as a result of these surges.

Surge arresters are usually composed of ceramic cylindrical vessels filled with gas with two electrodes arranged at the ends.

Traditional coatings for surge arrester electrodes have been composed of a mixture of barium, aluminum and nickel.

The disadvantage of these coatings is that they are light sensitive and they operate more effectively under well lit conditions as opposed to darker environments. This sensitivity to light is due to the fact that light acts on the gas contained in the vessel increasing the ability of the arrester to perform its function. Other types of surge arresters have electrodes coated with radioactive material which may be dangerous to use and to manufacture, thereby increasing the cost.

The purpose of the present invention is to eliminate these disadvantages. This object of the invention, together with others which will appear subsequently, is achieved by using an electrode coating composition comprising at least some aluminum, titanium and a product of the MA or ($M^{n+}$, $A^{n-}$) type in which M represents an alkaline metal, A a sulphate or a carbonate of this metal, and n being equal to 1 or 2. Tungsten may be substituted for titanium.

Other characteristics and advantages of the invention will appear on reading the following description of the invention, and the drawings appended hereto in which.

Figure 1:
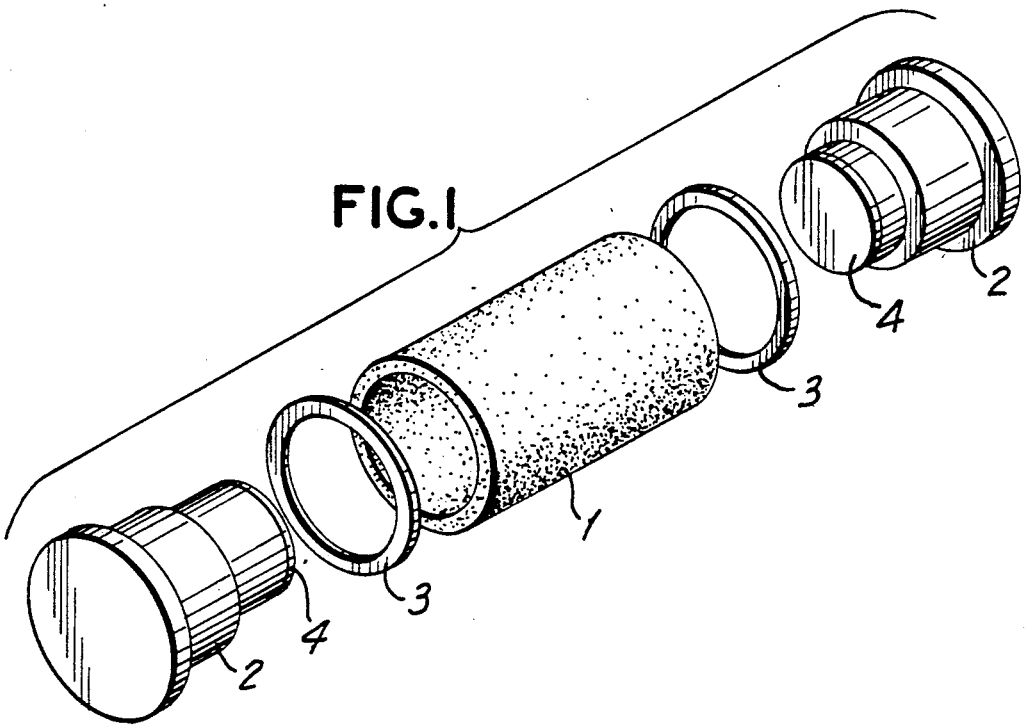
FIG. 1 is an exploded view of a surge arrester.
Figure 2:
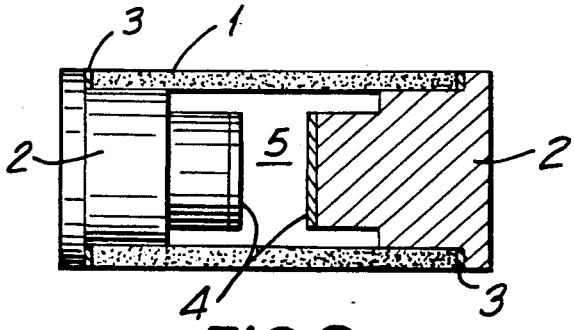
FIG. 2 is a sectional view of a surge arrester.

As can be seen on FIG. 1, the surge arrester is made up of a ceramic cylindrical tube (1) open at both ends and having two copper electrodes (2). The two electrodes (2) are arranged at each end of the tube and rings (3) are inserted between this tube (1) and each electrode (2). The electrodes are brazed onto the ceramic by means of these operation, a vacuum is created in the internal space (5) of the surge arrester which is then filled with a gas of the argon, nitrogen or hydrogen type. The electrodes (2) of the surge arrester are covered with an improved coating (4) which is the subject of the present invention.

Two preferential methods of producing the coating are described by way of examples:

EXAMPLE 1

In a preferred composition, the coating is made up of the following compounds in the proportions given:

- $BaAl_4Ni$ in powder form: approximately 10 to 50 grams,
- Titanium in powder form: approximately 0.90 to 4.30 grams,
- Xi which can be either
  - $K_2SO_4$ and all products of the type ($K^{2+}$, $A^{2-}$) or ($K^+$, $A^-$) in the proportion of approximately 0.6 to 2.6 grams,
  - or $Rb_2CO_3$ and all products of the type ($Rb^{2+}$, $A^{2-}$) or ($Rb^+$, $A^-$) in the proportion from approximately 0.4 to 7 grams,
  - or $Cs_2CO_3$ and all products of the type ($Cs^{2+}$, $A^{2-}$) or ($Cs^+$, $A^-$) in the proportion from approximately 0.35 to 1.65 grams,
- nitrocellulose dissolved in butyl acetate. The proportion of nitrocellulose in the butyl acetate is about 0.6 percent by volume of the butyl acetate. The weight of this mixture is about one gram.

All these constituents are mixed for approximately 15 minutes so as to obtain a homogeneous mixture. $BaAl_4Ni$ is commercially available from Pechiney, 23 Rue Balzac, 75008 Paris, France.

This coating composition is especially suited to the coating of miniature surge arresters.

EXAMPLE 2

Another preferred composition of the coating is as follows:

- Silicon hydroxide: approximately 6.4 to 25.6 grams,
- $BaCO_3$: approximately 2 to 7.9 grams,
- ($Na_2CO_3 \cdot 10H_2O$): approximately 1.8 to 7.1 grams,
- $Rb_2CO_3$: 0.24 to 7 grams,
- Aluminium in powder form: 1.6 to 6.4 grams,
- Titanium in powder form: 0.66 to 2.66 grams.

These compounds are also mixed together so as to produce a homogeneous paste.

The second preferred composition is especially suited for the coating of button-gaps and three element surge arresters.

Figure 3:
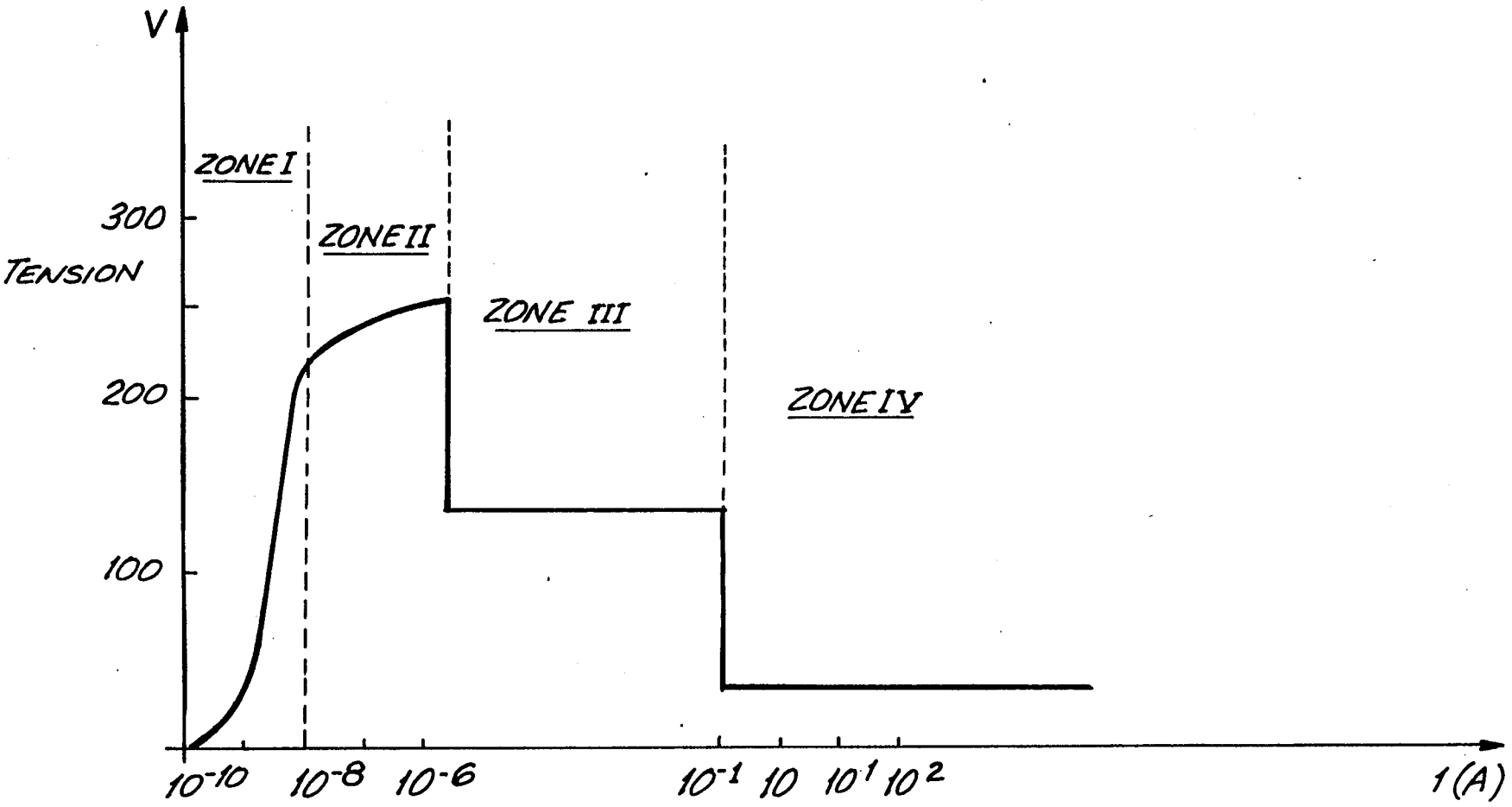
FIG. 3 is a characteristic curve showing the voltage as a function of the intensity during the operation of a surge arrester.

A characteristic curve of a surge arrester breaking down in a range of 220 to 280 volts has been produced (see FIG. 3.). 4 zones can be distinguished on this curve and will be described in detail.

Zone 1: When the voltage is increased at the terminals of the surge arrester ($\vec{E} = -\overrightarrow{\text{grad}}\ U$), there is no drop in voltage given the great initial resistance of the surge arrester. The resistance is in fact greater than 1 gigohm. A leakage current is nevertheless observed due to the ionization of the coating:

$$A + e^- \rightarrow A^* = e^- \quad A^* = \text{excited atom}$$

$$A + e^- \rightarrow A^+ + 2e^-$$

This leakage current, although weak, will increase with the electric field.

Zone 2: At the limit of zone 1 it is presumed that the atoms of the coating which can be ionized are in fact ionized. There is noted a stabilization of the potential V which could be explained by two hypotheses:

1) either an ionized atom (the barium in this case) gives up its second peripheral electron, 2) or the buildup of charges on the one hand and the repercussion of the electrons on the gas on the other hand reduce the resistance.

Zone 3: At the end of zone 2 we note an avalanche effect due to the multiplication of the carriers. There is a drop in the resistance value of the surge arrester. The gas is ionized by causing an electron to collide with an atom ("glow" conditions).

$$e^- + A_{gas} \rightarrow A^+ = h\gamma + e^-$$

Zone 4: In this zone the electrons go from one electron to another which results in arc conditions. The barium ensures breakdown of the surge arrester, the aluminium plays the role of a binder between the coating and the copper electrons, and the nickel behaves like a binder and therefore absorbs a lot of energy. The titanium plays a dual role. On the one hand it provides good stability for the breakdown voltage and on the other hand it absorbs a great deal of energy during the test and thus protects the materials of low calorific capacity. By doping the silicon, it gets rid of a lot of energy so as to protect the coating as a whole.

The role of all the alkaline metals is to lower the potential barrier, which gives breakdown voltage stability both in light and darkness.

I claim:

1. A composition for coating the electrodes of a surge arrestor comprising aluminum, titanium and a product of the type MA or ($M^{n+}A^{2-}$) in which M represents an alkaline earth or alkali metal, A a sulphate or carbonate of this metal and n is equal to 1 or 2.

2. A composition for coating the electrodes of a surge arrester comprising $BaAl_4Ni$, titanium, nitrocellulose dissolved in butyl acetate and a product of the type, MA or ($M^{n+}$, $A^{2-}$) in which M represents an alkaline earth or alkaline metal, A a sulphate or a carbonate of this metal and n is equal to 1 or 2.

3. A composition according to claim 2 wherein there is 10 to 50grams of $B_aAl_4N_i$, about 0.90 to about 4.30 grams of titanium, nitrocellulose dissolved in butyl acetate and a product of the type MA or ($M^{n+}$, $A^{2-}$) in which M represents an alkaline earth or alkali metal, A is a sulphate or a carbonate of this metal and n is equal to 1 or 2.

4. A composition according to claim 2 or 3 wherein the product of the MA type is $K_2SO_4$ and the composition contains about 0.6 to about 2.6 grams of $K_2SO_4$.

5. A composition according to claim 2 the product of the MA type is $Rb_2CO_3$ and the composition contains about 0.4 to about 7 grams of $Rb_2CO_3$.

6. A composition according to claim 2 wherein the product of the MA type is $Cs_2CO_3$ and the composition contains about 0.35 to about 1.65 grams of $Cs_2CO_3$.

7. A composition for coating the electrodes of a surge arrester comprising aluminum tungsten and a product of the type MA or ($M^{n+}$, $A^{2-}$) in which M represents an alkaline earth or alkali metal, A a sulphate or a carbonate of this metal and $n^-$ is equal to 1 or 2.

8. A composition according to claim 7 which comprises silicon hydroxide, aluminium, titanium and a product of the type MA or ($M^n$, $A^{2-}$) in which M represents an alkaline earth or alkali metal, A a sulphate or a carbonate of this metal and n is equal to 1 or 2.

9. A composition according to claim 8 containing about 6.4 to about 25.6 grams of silicon hydroxide, about 2 to about 7.9 grams of $BaCO_3$, about 1.6 to 6.4 grams of aluminium and about 0.66 to 2.66 grams of titanium, and about 1.8 to about 7.1 grams of a product selected from the group consisting essentially of ($M^{2+}$, $A^{2-}$) or of the type ($M^+$, $A^{2-}$).

* * * * *